US007748831B2

(12) United States Patent
Umeda

(10) Patent No.: US 7,748,831 B2
(45) Date of Patent: Jul. 6, 2010

(54) INKJET RECORDING APPARATUS

(75) Inventor: Takaichiro Umeda, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 763 days.

(21) Appl. No.: 11/590,416

(22) Filed: Oct. 31, 2006

(65) Prior Publication Data

US 2007/0097190 A1 May 3, 2007

(30) Foreign Application Priority Data

Oct. 31, 2005 (JP) ..... 2005-317052

(51) Int. Cl.
*B41L 2/174* (2006.01)

(52) U.S. Cl. ..... 347/85; 347/87

(58) Field of Classification Search ..... 347/84, 347/85, 86, 87

See application file for complete search history.

(56) References Cited

U.S. PATENT DOCUMENTS

| | | | | |
|---|---|---|---|---|
| 5,237,342 | A * | 8/1993 | Saikawa et al. | 347/87 |
| 6,174,049 | B1 | 1/2001 | Tachihara et al. | |
| 6,474,797 | B2 * | 11/2002 | Kurata et al. | 347/85 |
| 6,966,637 | B2 * | 11/2005 | Ishizaki | 347/85 |
| 6,966,641 | B2 * | 11/2005 | Taniguchi et al. | 347/86 |
| 7,198,342 | B2 * | 4/2007 | Mizoguchi | 347/7 |
| 7,318,639 | B2 * | 1/2008 | Udagawa | 347/85 |
| 2005/0024397 | A1 | 2/2005 | Mizoguchi | |
| 2005/0225612 | A1 | 10/2005 | Lee et al. | |

FOREIGN PATENT DOCUMENTS

| | | |
|---|---|---|
| JP | 10-85121 | 4/1998 |
| JP | 2001334687 | 12/2001 |
| JP | 2002079684 | 3/2002 |
| JP | 2004188639 | 7/2004 |
| JP | 2004188640 | 7/2004 |
| JP | 2005-47058 | 2/2005 |
| JP | 2005028859 | 2/2005 |
| JP | 2005-520709 | 7/2005 |

* cited by examiner

*Primary Examiner*—Anh T. N. Vo
(74) *Attorney, Agent, or Firm*—Frommer Lawrence & Haug LLP

(57) ABSTRACT

An inkjet recording apparatus including a main tank, a sub tank, a supply device, and a recording head is provided. The main tank stores ink. The sub tank includes a storage chamber that houses an absorber for absorbing the ink and a supply port that communicates with the storage chamber at an upper portion of the sub tank. The supply device supplies the ink from the main tank to the sub tank through the supply port of the sub tank. The recording head discharges the ink supplied from the sub tank and performs recording while reciprocating over a recording medium. The sub tank further includes a gap inside the storage chamber that guides the ink supplied by the supply device toward a lower portion of the absorber.

10 Claims, 4 Drawing Sheets

INKJET RECORDING APPARATUS

CROSS-REFERENCE TO RELATED APPLICATIONS

This application claims the benefit of Japanese Patent Application No. 2005-317052 filed Oct. 31, 2005 in the Japanese Patent Office, the disclosure of which is incorporated herein by reference.

BACKGROUND

The present invention relates to an inkjet recording apparatus using a supply system for supplying ink from a main tank to a sub tank attached to a recording head.

There is a known inkjet recording apparatus using a station supply system for supplying ink from a main tank provided to a main body to a sub tank attached to a recording head. In the inkjet recording apparatus, a carriage, on which the recording head is mounted, is moved to a specified supply position. Then, the main body and the sub tank on the carriage are connected through a connection member, and ink is supplied from the main tank to the sub tank in a connected state.

An absorber is housed in the sub tank. When ink is supplied through a supply port opened in an upper surface of the sub tank, the ink is absorbed by the absorber and is retained in the sub tank. When the ink absorbed in the absorber is discharged from a nozzle, a back-pressure (a negative pressure) is generated by the absorber thereby to generate a meniscus in the nozzle.

SUMMARY

The above described inkjet recording apparatus, however, involves the following problems: Repeated supply of ink is prone to result in unevenly accumulated ink in an upper portion of the absorber in the vicinity of the supply port. When the absorber repeatedly absorbs ink, air in the absorber is not discharged and remains in the absorber as an air bubble. Sometimes an ink layer and an air layer are layered in the absorber. When ink is unevenly accumulated in the upper portion of the absorber, the ink cannot be supplied to the nozzle. Once an air bubble or an air layer is generated in the absorber, an amount of ink capable of being absorbed in the absorber during a subsequent supply of ink is reduced. That is, an absorption capacity of the absorber is reduced, and thus an amount of recording by one supply of ink is reduced.

One aspect of the present invention may provide an inkjet recording apparatus in which reduction of the absorption capacity of the absorber during repeated supply of ink is suppressed.

In the one aspect of the present invention, there is provided an inkjet recording apparatus which includes a main tank, a sub tank, a supply device, and a recording head. The main tank stores ink. The sub tank includes a storage chamber that houses an absorber for absorbing the ink and a supply port that communicates with the storage chamber at an upper portion of the sub tank. The supply device supplies the ink from the main tank to the sub tank through the supply port of the sub tank. The recording head discharges the ink supplied from the sub tank and performs recording while reciprocating over a recording medium. The sub tank further includes a gap inside the storage chamber that guides the ink supplied by the supply device toward a lower portion of the absorber.

BRIEF DESCRIPTION OF THE DRAWINGS

Preferred embodiments of the present invention will be described hereinafter with reference to the drawings, in which.

DETAILED DESCRIPTION OF THE PREFERRED EMBODIMENTS

Figure 1:
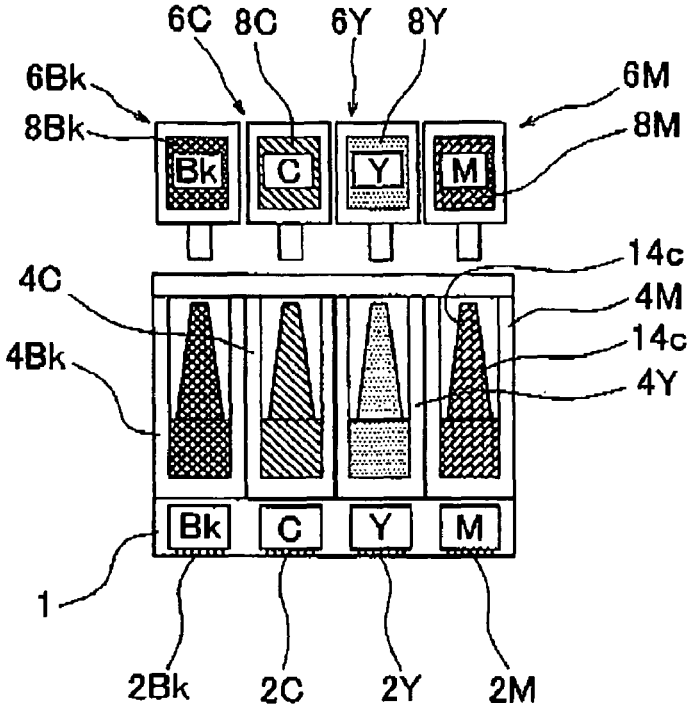
FIG. 1 is a front elevation view showing a schematic structure of an inkjet recording apparatus in an embodiment of the present invention.

FIG. 1 shows a schematic structure of a vicinity of a recording head in an inkjet recording apparatus of an embodiment of the present invention. Since a structure of such an inkjet recording apparatus is well known, no further detailed description will be presented.

As shown in FIG. 1, the recording head 1 discharges ink from nozzles 2 by driving a piezoelectric element, an electric thermal converter, and the like. In the present embodiment, the recording head 1 discharges inks of four colors of Bk (black), C (cyan), Y (yellow) and M (magenta) from the respective nozzles 2Bk, 20, 2Y and 2M. The recording head 1 is reciprocably supported by a not shown main body, and performs recording while reciprocating over a not shown recording medium.

The recording medium may be, for example, a recording sheet, a resin sheet, a post card, an envelope, or an optical disk, such as a CD-R (Compact Disk-Recordable) or DVD-R (Digital Versatile Disk-Recordable).

Sub tanks 4Bk, 4C, 4Y and 4M respectively for the four colors are attached to the recording head 1. Supply mechanisms 6Bk, 6C, 6Y and 6M are provided to the not shown main body as supply devices respectively for the four colors of Bk (black), C (cyan), Y (yellow) and M (magenta). The supply mechanisms 6Bk, 6C, 6Y and 6M are arranged corresponding to a predetermined supply position of the recording head 1 so that ink may be supplied when the recording head 1 moves to the predetermined supply position.

Main tanks 8Bk, 8C, BY and 8M for the four colors of Bk (black), C (cyan), Y (yellow) and M are provided to the not shown main body. The supply mechanisms 6Bk, 6C, 6Y and 6M are capable of respectively applying pressure to and supplying corresponding inks in the main tanks 8Bk, 8C, BY and 8M.

Each of the sub tanks 4Bk, 4C, 4Y and 4M has a same configuration. Each of the supply mechanisms 6Bk, 6C, 6Y and 6M has a same configuration. Each of the main tanks 8Bk, 8C, 8Y and 8M has a same configuration. Therefore, a detailed description will be made hereinafter about one sub tank 4, one supply mechanism and one main tank 8.

Figure 2:
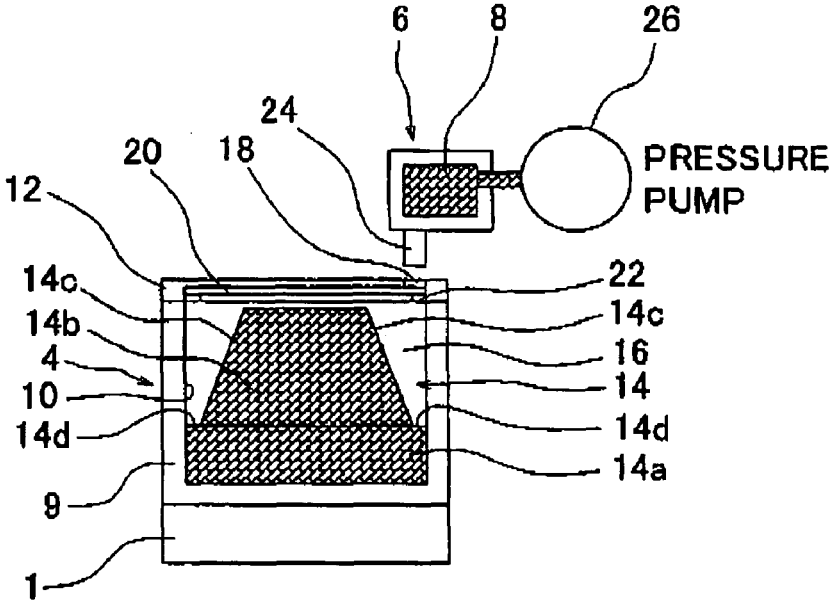
FIG. 2 is a side elevation view showing the schematic structure of the inkjet recording apparatus in the embodiment.

As shown in FIG. 2, the sub tank 4 includes a substantially rectangular container 9 and a cover member 12. A substantially rectangular storage chamber 10 is formed in the container 9. The storage chamber 10 has an opening that is opened upward and may be closed by being covered with the cover member 12.

An absorber 14 housed in the storage chamber is made of an ink absorbing material such as a polyurethane porous material. The absorber 14 applies a back-pressure (a negative pressure) to the recording head 1 thereby to generate a meniscus in each of the nozzles 2. The absorber 14 also supplies an absorbed ink to the recording head 1 in accordance with a driving of a piezoelectric element, an electric thermal converter, and the like.

In the present embodiment, a gap 16 is formed between an interior wall of the container 9 of the sub tank 4 and the absorber 14. A lower part 14*a* of the absorber 14 is closely fitted in a lower portion of the storage chamber 10, and thus a bottom surface of the storage chamber 10 is completely covered with the lower part 14*a* of the absorber 14. The gap 16 is formed above a specified height from the bottom surface of the storage chamber 10 so as not to obstruct an application of the back-pressure to each of the nozzles 2 to generate a meniscus.

An upper part 14*b* of the absorber 14 is tapered upward toward the opening of the storage chamber 10 to have a smaller cross-sectional area at a top end of the upper part 14*b*. The upper part 14*b* has a trapezoidal side configuration and has four inclined surfaces 14*c*, each facing the interior wall of the container 9 (see FIG. 1 and FIG. 2). As a result, the gap 16 is formed, in the present embodiment, such that the gap 16 surrounds the upper part 14*b* of the absorber 14 over an entire circumference of the interior wall of the container 9. The gap 16 is also formed to be symmetrical with respect to a plumb line. A shoulder portion 14*d* is formed between the lower part 14*a* and the upper part 14*b* of the absorber 14.

It is preferable to form the absorber 14 by cutting a part corresponding to the gap 16 from an integral material. It is not preferable to form the lower part 14*a* and the upper part 14*b* separately and then form the absorber 14 by stacking the upper part 14*b* on the lower part 14*a*. In a case of forming separately, a boundary is formed between the upper part 14*b* and lower part 14*a*, and is likely to obstruct an ink flow between the upper part 14*b* and lower part 14*a*.

Figure 3A:
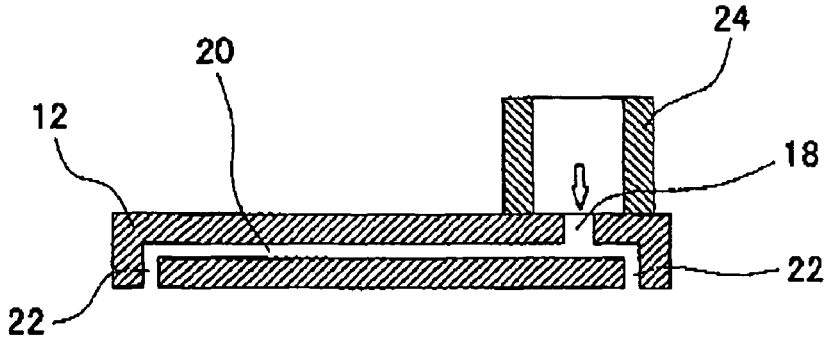
FIGS. 3A and 3B are explanatory views of a cover member in the embodiment.

As shown in FIG. 3A, a supply port 18 is formed to be opened upward in the cover member 12. A hollow portion 20 communicating with the supply port 18 is formed in the cover member 12. The hollow portion 20 has substantially a same size as the opening of the storage chamber 10. A plurality of distribution apertures 22 are formed in the cover member 12 so as to communicate the hollow portion 20 and the storage chamber 10.

Figure 3B:
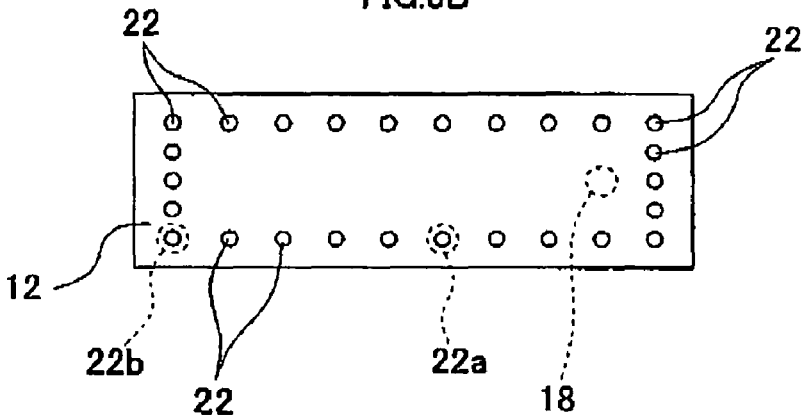

As shown in FIG. 3B, the plurality of distribution apertures 22 are aligned in a rectangular array along the interior wall of the container 9. The plurality of distribution apertures 22 are opened above the gap 16. All the plurality of distribution apertures 22 may have the same size. Alternatively, a size of the each of the distribution apertures 22 may become larger as a distance of the each of the distribution apertures 22 from the supply port 18 becomes larger (for example, as shown by 22*a* and 22*b* in FIG. 3B). This may cause the ink supplied from the supply port 18 to the hollow portion 20 to fall evenly through the plurality of distribution apertures 22. The distribution apertures 22 may be formed in a vicinity of the interior wall of the container 9 to cause the ink fall through the distribution apertures 22 to flow down on the interior wall of the container 9.

Figure 4:
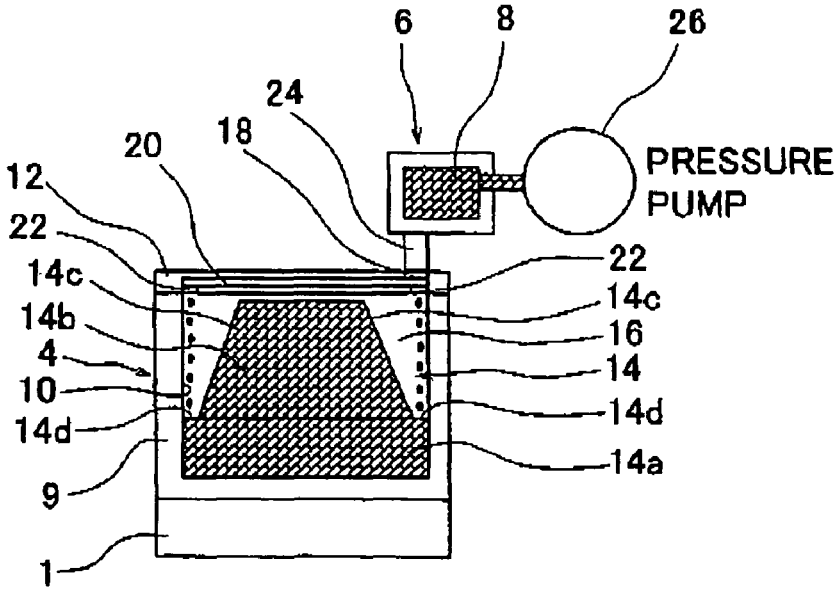
FIG. 4 is a side elevation view showing a state of ink supply in the inkjet recording apparatus of the embodiment.

As shown in FIG. 4, the supply mechanism 6 is provided with a pressure pump 26 that applies pressure to the ink in the main tank 8 and discharges the pressurized ink from a connection tube 24.

When the recording head 1 moves to the supply position, the connection tube 24 relatively moves with respect to the recording head 1 such that the connection tube 24 may be connected to the supply port 18 of the sub tank 4. In this state, the ink may be supplied from the main tank 8 to the sub tank 4.

Alternatively, the sub tank 4 may be configured to move such that the connection tube 24 may be connected to the supply port 18. The connection tube 24 of the supply mechanism 6 may be configured to move such that the connection tube 24 may be connected to the supply port 18.

Figure 5:
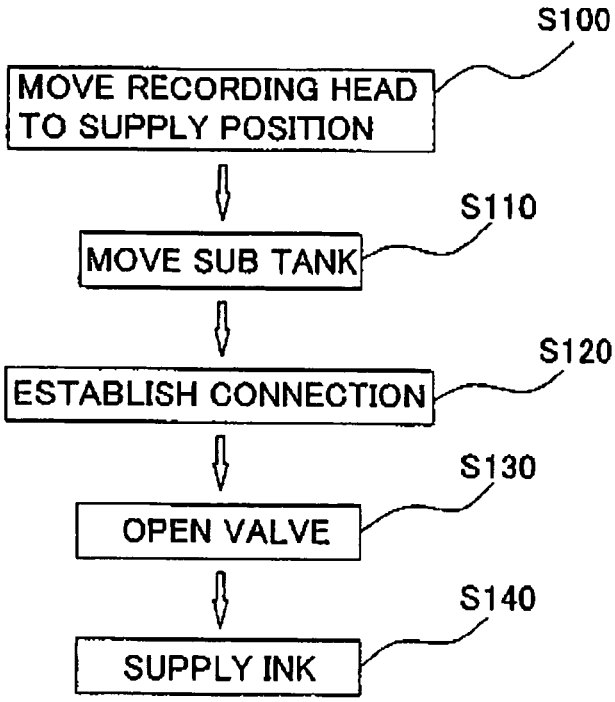
FIG. 5 is a flowchart showing a process of an ink supply operation in the inkjet recording apparatus of the embodiment.

A description will now be made below of an operation of the inkjet recording apparatus of the present embodiment with reference to FIG. 5.

First, the recording head 1 discharges the ink in the sub tank 4 from the nozzles 2 by driving a piezoelectric element, an electric thermal converter, and the like, while reciprocating over the not shown recording medium. Thus, recording is performed on the recording medium. When the ink absorbed by the absorber 14 in the sub tank is consumed, the recording head 1 is moved to the supply position at a predetermined timing (Step 100, hereinafter referred to as "S100"; hereinafter the same is applied).

For example, the sub tank 4 is moved upward by a relative movement between the recording head 1 moved to the supply position and the connection tube 24 of the supply mechanism 6 (S110). Then, as shown in FIG. 4, a connection between the connection tube 24 and the supply port 18 of the sub tank 4 is established (S120).

Subsequently, a not shown valve is opened (S130). The ink in the main tank 8 is supplied to the hollow portion 20 through the connection tube 24 and the supply port 18 (S140) by driving the pressure pump 26. The ink supplied to the hollow portion 20 falls through the plurality of distribution apertures 22 and enters the gap 16.

The ink which has entered the gap 16 falls within the gap 16 or falls along the interior wall of the container 9. Then, the ink guided by the gap 16 reaches the lower part 14*a* of the absorber 14. The ink is absorbed into the absorber 14 through the lower part 14*a* of the absorber 14 located under the gap 16 along the circumference of the interior wall of the container 9. The ink penetrates from a circumference of the lower part 14*a* of the absorber 14 under the gap 16 toward a central portion of the absorber 14. Further, the ink penetrates from the lower part 14*a* toward the upper part 14*b*.

In accordance with the consumption of the ink, air is absorbed into the absorber 14. However, the air is forced from the circumference of the lower part 14*a* toward the central portion of the absorber 14 due to penetration of the ink. The air is also forced from a lower side toward an upper side due to the penetration of the ink. This may suppress an air bubble or an air layer from remaining in the absorber 14.

Accordingly, the absorber 14 may absorb an amount of ink corresponding to a volume of the absorber 14. In other words, reduction of the amount of ink to be absorbed due to a remaining air bubble or air layer may be suppressed. Even after ink is supplied repeatedly, an air bubble or an air layer is unlikely to remain, and the amount of ink corresponding to the volume of the absorber 14 may be absorbed.

Since the ink is guided by the gap 16 to the lower part 14*a* of the absorber 14, the ink is first absorbed from the circumference of the lower part 14*a* of the absorber 14 under the gap 16. In an entire ink in the absorber 14, ink in the lower part 14*a* is first supplied to the recording head 1. Accordingly, even if the ink is absorbed in a concentrated manner in the lower part 14*a* of the absorber 14, the ink may be supplied to the recording head 1 without any trouble.

As described above, the ink enters the gap 16 through the plurality of distribution apertures 22. When a size of each of the distribution apertures 22 is configured to become larger as a distance of the each of the distribution apertures 22 from the supply port 18 becomes larger, the ink may enter the gap 16 evenly through the plurality of distribution apertures 22. Accordingly, the ink may be evenly supplied to an entire area of the lower part 14*a* of the absorber 14 from under the gap 16. Then, the ink evenly penetrates from the circumference of the lower part 14*a* of the absorber 14, and thus is evenly absorbed into the absorber 14.

An outer circumference of the upper part 14*b* of the absorber 14 is formed as inclined surfaces 14*c* as described above. When the ink, which has fallen in the gap 16 through the distribution apertures 22, hits the inclined surfaces 14*c*, part of the ink is absorbed from the inclined surfaces 14*c*. Remaining part of the ink falls down along the inclined surfaces 14*c* to an area under the gap 16. Accordingly, a large amount of ink gathers in the area under the gap 16 and is absorbed by the lower part 14*a* of the absorber 14 from under the gap 16. Thus, an air bubble or an air layer may be suppressed from remaining in the absorber 14 even after ink is supplied repeatedly.

Figure 6A:
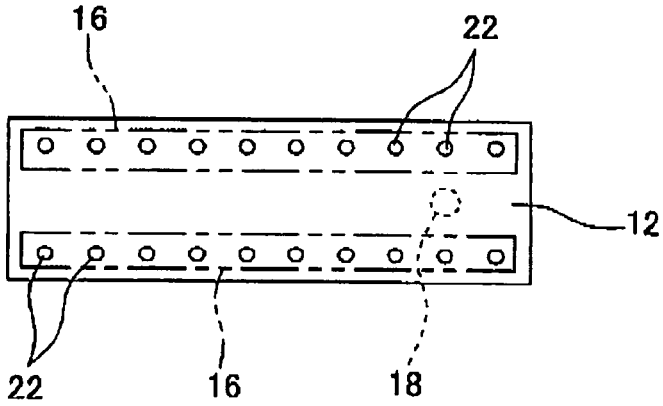
FIG. 6A is an enlarged bottom view of a cover member having a different arrangement of distribution apertures in another embodiment.
Figure 6B:
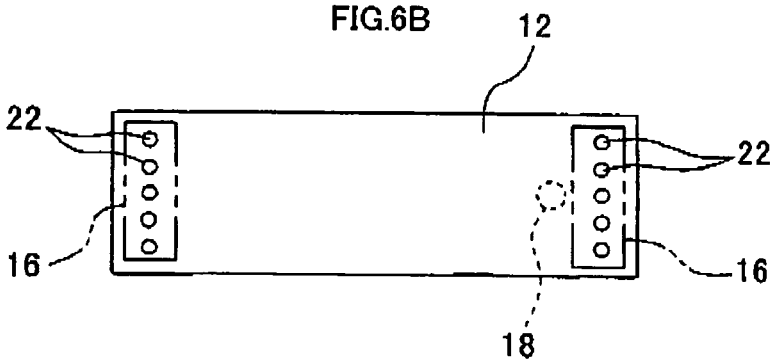
FIG. 6B is an enlarged bottom view of a cover member having a different arrangement of distribution apertures in a further embodiment.

FIGS. 6A and 6B are enlarged bottom views each showing a cover member 12 having a different arrangement of distribution apertures 22 from the arrangement in the above described embodiment.

Specifically, as shown in FIG. 6A, the plurality of distribution apertures 22 may be provided so as to be aligned in two rows along respective longitudinal sides of the rectangular. In this case, the gap 16 may be provided to form two rows along respective long sides of the rectangular under the distribution apertures 22 instead of all around the absorber 14. As shown in FIG. 6B, the plurality of distribution apertures 22 may be provided so as to be aligned in two rows along respective short sides of the rectangular. In this case, the gap 16 may be provided to form two rows along respective short sides of the rectangular under the distribution apertures 22 instead of all around the absorber 14. It may be preferable to provide the gap 16 and the plurality of distribution apertures 22 in a symmetrical manner with respect to the plumb line.

Figure 7:
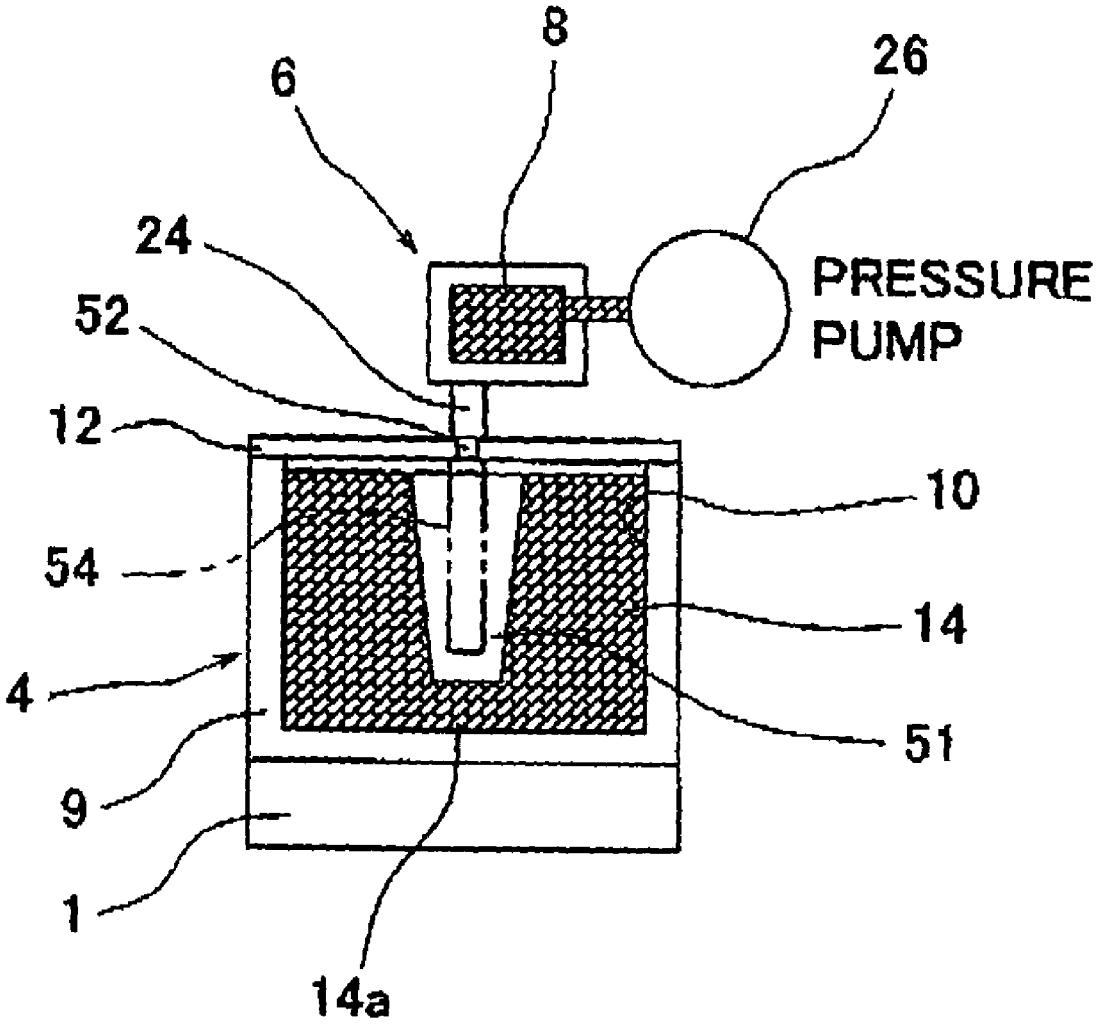
FIG. 7 is a side elevation view showing a schematic structure of an inkjet recording apparatus in a yet further embodiment.

In FIG. 7, a gap 51 is formed in a central portion of the absorber 14 from a side of the opening of the storage chamber 10 downward. The gap 51 has a reverse trapezoidal cross-section. Below a bottom surface of the gap 51, the lower part 14*a* of the absorber 14 is provided over an entire bottom surface of the storage chamber 10.

A supply port 52 is formed in a central portion of the cover member 12 so as to be opened right above the gap 51 toward the storage chamber 10. In a same manner as in the above described embodiment, the connection tube 24 is connected to the supply port 52. When ink is supplied from the main tank 8, the ink falls through the supply port 52 and within the gap 51 to reach the bottom surface of the gap 51. Then, the ink is absorbed from the bottom surface of the gap 51 into the lower part 14*a* of the absorber 14. The absorbed ink penetrates the absorber 14 from a central portion toward a peripheral portion and also from a lower portion toward an upper portion.

Accordingly, air absorbed into the absorber 14 in accordance with the consumption of the ink is forced from the central portion to the peripheral portion and also from the lower portion toward the upper portion. This may suppress an air bubble or an air layer from remaining in the absorber 14. Thus, the absorber 14 may absorb an amount of ink corresponding to a volume of the absorber 14. In other words, reduction of the amount of ink to be absorbed due to a remaining air bubble or air layer may be suppressed.

Since the ink is guided by the gap 51 to the lower part 14*a* of the absorber 14, the ink may be supplied to the recording head 1 without any trouble even if the ink is absorbed in a concentrated manner in the lower part 14*a* of the absorber 14. When an introduction pipe 54 communicating with the supply port 52 is provided toward the bottom surface of the gap 51, as shown by a two-dotted chain line in FIG. 7, the ink may be more surely guided to the bottom surface of the gap 51.

It is to be understood that the present invention should not be limited to the above described embodiments, but may be embodied in various forms without departing from the spirit and scope of the present invention.

What is claimed is:

1. An inkjet recording apparatus, comprising:

a main tank that stores ink;

a sub tank, including a storage chamber that houses an absorber for absorbing the ink and a supply port that communicates with the storage chamber at an upper portion of the sub tank;

a supply device that supplies the ink from the main tank to the sub tank through the supply port of the sub tank; and a recording head that discharges the ink supplied from the sub tank and performs recording while reciprocating over a recording medium;

wherein the sub tank further includes a gap inside the storage chamber that guides the ink supplied by the supply device toward a lower portion of the absorber;

wherein the sub tank further includes at least one aperture opened over the storage chamber at the upper portion of the sub tank, and the ink from the supply port is guided to the aperture; and wherein the gap is formed directly under the aperture.

2. The inkjet recording apparatus according to claim 1;

wherein the gap is formed between the absorber and an interior wall of the sub tank.

3. The inkjet recording apparatus according to claim 2;

wherein the gap extends to a predetermined height from a bottom of the absorber.

4. The inkjet recording apparatus according to claim 1;

wherein a cross-sectional area of the gap becomes smaller downward by forming an inclined surface in the absorber.

5. The inkjet recording apparatus according to claim 1;

wherein the lower portion of the absorber closely contacts an interior wall of the sub tank.

6. The inkjet recording apparatus according to claim 1;

wherein the ink supplied to the sub tank enters the gap before the ink reaches the absorber, and the ink falls within the gap to reach the lower portion of the absorber.

7. The inkjet recording apparatus according to claim 1;

wherein the gap is provided in a portion of the absorber right under the supply port.

8. An inkjet recording apparatus, comprising:

a main tank that stores ink;

a sub tank, including a storage chamber that houses an absorber for absorbing the ink and a supply port that communicates with the storage chamber at an upper portion of the sub tank;

a supply device that supplies the ink from the main tank to the sub tank through the supply port of the sub tank; and a recording head that discharges the ink supplied from the sub tank and performs recording while reciprocating over a recording medium;

wherein the sub tank further includes a gap inside the storage chamber that guides the ink supplied by the supply device toward a lower portion of the absorber;

wherein the sub tank further includes a plurality of distribution apertures opened over the storage chamber at the upper portion of the sub tank, and the ink from the supply port is guided to the distribution apertures; and wherein the gap is formed directly under the distribution apertures.

9. The inkjet recording apparatus according to claim 8;

wherein as a distance of each of the distribution apertures from the supply port becomes larger, a size of the each of the distribution apertures becomes larger.

10. An inkjet recording apparatus, comprising:

a main tank that stores ink;

a sub tank, including a storage chamber that houses an absorber for absorbing the ink and a supply port that communicates with the storage chamber at an upper portion of the sub tank;

a supply device that supplies the ink from the main tank to the sub tank through the supply port of the sub tank; and a recording head that discharges the ink supplied from the sub tank and performs recording while reciprocating over a recording medium;

wherein the sub tank further includes a gap inside the storage chamber that guides the ink supplied by the supply device toward a lower portion of the absorber;

wherein the supply port is provided in a central upper portion of the sub tank; and wherein the gap is provided in a portion of the absorber right under the supply port.

* * * * *